US005183292A

United States Patent [19]

Ragin, III

[11] Patent Number: 5,183,292

[45] Date of Patent: Feb. 2, 1993

[54] DETACHABLE BRAKE FOR SKATE

[76] Inventor: John C. Ragin, III, P.O. Box 1316, Tempe, Ariz. 85280

[21] Appl. No.: 822,347

[22] Filed: Jan. 17, 1992

[51] Int. Cl.[5] ..... A63C 3/00

[52] U.S. Cl. ..... 280/825; 36/132; 280/11.22

[58] Field of Search ..... 280/825, 11.2, 11.22, 280/11.23, 30; 36/7.3, 132

[56] References Cited

U.S. PATENT DOCUMENTS

| | | | |
|---|---|---|---|
| 2,908,982 | 10/1959 | Corley | 36/1 |
| 3,114,982 | 12/1963 | McGowan | 36/2.5 |
| 3,306,610 | 2/1967 | Biggs, Jr. et al. | 272/57 |
| 3,861,697 | 1/1975 | Dolce | 280/11.1 R |
| 3,898,749 | 8/1975 | Famolare, Jr. | 36/2.5 R |
| 4,355,474 | 10/1982 | Grim | 36/132 |
| 4,364,187 | 12/1982 | Melendez | 36/15 |
| 4,413,842 | 11/1983 | Loredo | 280/825 |
| 4,507,882 | 4/1985 | Harrell | 36/136 |

*Primary Examiner*—David M. Mitchell
*Attorney, Agent, or Firm*—Craine & Vance

[57] ABSTRACT

Apparatus and methods to selectively secure wheels of a skate against rotation, provide a pad between the wheels and an underlying surface, provide a separate detachable protective foot covering, and/or provide a separate storage compartment which is removably attached to a boot of said skate. The invention also applies to ice skates, providing a pad between the blade and the underlying surface, providing a protective foot covering, and providing a storage compartment as described above.

17 Claims, 3 Drawing Sheets

DETACHABLE BRAKE FOR SKATE

COPYRIGHT NOTICE

© Copyright 1991, James R. Vance. All Rights Reserved.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyrights whatsoever.

TECHNICAL FIELD

This invention relates to accessories for skates. More particularly, this invention relates to apparatus and methods for selectively and releasably preventing the rotation of a plurality of wheels of either an in-line or standard skate upon an underlying support surface, providing a pad between the in-line skate and an underlying surface, providing a separate detachable protective foot covering, and providing a separate storage compartment which is removably attached to the boot of the in-line skate. This invention may also be used on a traditional ice skate as a shock-absorbent walking pad, as a separate storage compartment, and as a separate detachable protective foot covering.

BACKGROUND OF THE INVENTION

The recreation of outdoor, in-line skating is fast becoming a new national pastime. In-line skating is a form of roller skating wherein the wheels of each skate are placed within a single plane. Such skates have been on the market for only a few years. During that time period, sales of in-line skates have experienced phenomenal growth. Continued and increased sales growth of such skates is undoubted.

The in-line skating recreation is not without difficulties. For example, once in-line skaters have removed their regular street shoes and donned their skates, they often do not have a safe place to store their street shoes.

During the course of skating, the skater may need to enter a store, snack bar, restroom, stairwell, or other structure. The skater may try to skate into such places. Since in-line skates do not have means to secure the wheels against rotation, it is often very dangerous to skate within such places. The skater may inadvertently slip, roll, or be unable to stop. A particular danger exists when a skater attempts to ascend or descend stairs.

Due to the aforementioned dangers and the associated exposure to liability, many establishments simply disallow use of skates within their buildings and stores. Consequently, the skaters must go through the time-consuming and cumbersome task of removing their skates.

If the skaters have not brought their regular street shoes on the present excursion, the skaters are left barefooted with their skates in hand. These actions expose the skaters to similar dangers as mentioned above, but now only barefooted. Again, many businesses simply disallow the entrance of barefooted persons into their establishments or onto their property.

It is a common desire with those who in-line skate to wear as little clothing as possible. To do so allows the skaters to remain cool and to rid themselves of bulky, heavy baggage. There still remains a need, however, to wear a backpack or fanny pack to carry and store such items as extra clothing, a wallet, purse, keys, extra socks, t-shirt, first aid kit, etc. Use of a traditional backpack or fanny pack, however, interferes with the desire of the skater to have free, unrestricted movement, and to cool and tan oneself.

In-line skaters also often discover that they are prevented from skating back to their initial starting location. Fatigue, exhaustion, blisters, a skating accident, difficult incline, and/or other reasons may all adversely impact the ability of the in-line skaters to return to their initial starting location.

When one of these unfortunate events occurs, the last thing skaters wish to do is to walk back to their starting location barefoot and tender on a hot asphalt or cement skating path.

In summary, in-line skaters are faced with the problems of storing street shoes, entering establishments wearing skates or going barefoot, carrying a backpack or fanny pack, and walking back to their starting location barefooted.

Persons who ice skate face many of the same problems as those who participate in the in-line skating sport.

The present invention overcomes the foregoing annoying and often dangerous problems encountered by persons who enjoy in-line roller skating, conventional roller skating, and/or ice skating sports.

DISCLOSURE OF INVENTION

The present invention includes apparatus and methods for selectively securing wheels of an in-line or conventional skate against rotation. This feature transforms the in-line and conventional skates into the equivalent of a regular, albeit elevated, street shoe or boot. Once this feature is engaged, the skater may safely enter establishments, buildings, stairwells, and other structures from which the skater would otherwise be barred. Attachment of the invention to the in-line or conventional skate is readily apparent to observers. The function of the invention is also readily ascertained by observers. Thus, store owners which bar use of skates within their establishments and buildings can quickly and easily observe that the wheels are locked and no longer function as skates. This enables such store owners and/or operators from creating unnecessary embarrassment for both the skater and the establishment by providing apparent notice that the skates have been locked against rotation and are temporarily nonfunctional.

Use of this invention also eliminates the need for the skater to remove the skates and enter such places barefooted. The skater is no longer required to enter stores, restaurants, public restrooms, and other public buildings barefooted, holding his or her skates.

The present invention also provides a pad between the skate and an underlying walking surface. This feature prevents any marring by the skates of the underlying surface or floor.

The pad also enables the skater to walk on terrain that would otherwise be inaccessible. For example, with the pad in place, the skater can walk on gravel or rough pavement with relative ease without damaging the wheels or blade of the skate.

The present invention may be removed from the skate and be used as a separate, detachable, protective foot covering. For example, the skater may select between wearing the skate in an operative rolling or gliding functional mode (as will be explained shortly), wearing the skate in a locked stationary mode as described above, or remove the skate and use the invention as a separate, lightweight, protective foot covering.

If the skater wishes to maintain the skate in a rolling or gliding, operational and functional mode, the invention may be used as a separate, storage compartment or pouch that is removably secured or attached to the boot of the skate. Use of the invention as a storage compartment enables the skaters to rid themselves of a plurality of bulky and/or cumbersome items, such as extra clothing and keys. Attachment of the invention to the boot of the in-line skate frees the hands, back, waist, shirt, and pants of the skater from having to carry such items.

With the exception that ice skates have a blade rather than rotatable wheels, the present invention could similarly be used on a traditional ice skate as a shock-absorbent walking pad, as a separate storage compartment, and as a separate detachable protective foot covering. The only difference is that reference hereafter to the wheels of the skate should be read as referring to the blade of the skate, and that the blade has a front portion and a rear portion rather than a front wheel and a rear wheel, respectively.

To accomplish the foregoing and other objectives, the invention generally comprises: (a) a protective foot covering; and (b) means for removably attaching and/or urging the protective foot covering to one or more locations on the skate.

The protective foot covering has a flexible sole and a flexible upper attached to the flexible sole. The flexible sole and the flexible upper define an enclosure wherein the foot of the skater can be placed.

In the first mode of use, the protective foot covering is juxtaposed against the wheels of the skate and serves as a flexible, shook-absorbent pad positioned between the wheels and the underlying support surface.

In the second mode of use, the protective foot covering serves as a storage compartment, pouch, pack, pocket, or bladder within which miscellaneous items may be stored. It is preferable that the protective foot covering is expandable to accommodate differently sized loads. For example, the upper of the protective foot covering may be manufactured from an elastic fabric material, as occurs when the protective foot covering simply comprises an aqua-shoe, an aqua-sock, or slipper.

In the third mode of use, the protective foot covering is removed from the skate and is used as a separate street shoe or slipper. The upper of the protective foot covering may further have an elastic heel strap or rear cinch band that urges the foot of the skater into the enclosure defined by the covering and holds the covering upon the foot of the skater.

The attachment means is operative in the first two of the three different modes of use or operation of the invention.

In the first mode of use, the invention serves as a brake assembly. The attachment means urges the protective foot covering into physical contact with the wheels to restrict the rotational movement of the wheels with respect to the frame within which the wheels are supported.

For example, the attachment means may comprise at least one elastic band which is removably secured to the skate. The elastic band is secured to the flexible sole near an instep or arch and near an opposite outstep of the protective foot covering. Securement is accomplished by having the elastic band being sewn, bolted, adhered, clamped, or otherwise affixed to the flexible sole of the protective foot covering. The elastic band may also be formed integrally with the flexible sole of the protective foot covering. The attachment means may also be provided with at least one pull tab which is secured to the elastic band.

In the preferred embodiment, the attachment means comprises a front loop and a rear loop. The front loop is pulled tautly over and is secured to or hooked onto a front end of the boot, skate frame, or undercarriage. The rear loop is similarly pulled tautly over and is secured to or hooked onto the rear end of the boot, skate frame, or undercarriage. If the frame of the skate is extended to accommodate the attachment of a rear brake pad, the rear loop can be pulled entirely over the brake pad and brake mount so that the rear loop contacts the undercarriage approximately below the heel of the boot.

In the second mode of use, the attachment means secures, attaches, and urges the protective foot covering against the back, front, and/or side of the boot of the skate in such a manner that the wheels are free to rotate. For example, the attachment means may comprise at least one elastic band which is removably secured to the skate. The elastic band then urges the flexible upper of the protective foot covering against the boot of the skate to restrict escape of the items from within the storage compartment. In the preferred embodiment, the elastic band has a front loop and a rear loop.

During the second mode of use, the invention is juxtaposed to and held against the outer body of the boot of the skate. For example, when juxtaposed against the skate boot, an elastic cord or band (such as a bungee cord having a hook located at each of its terminal ends) may be wrapped around the invention and the skate boot to urge the invention against the boot. If a bungee cord is used, the respective hooked ends of the cord can engage each other or be inserted into slots or opening provided in either the invention or in the skate boot.

Alternatively, during the second mode of use, the front loop as described above may be stretched to engage or hook onto the frame of the skate. The rear loop is then stretched to engage or hook onto an upper portion, tendon guard, or backstay of the boot. If a rear brake and rear brake housing are used, the rear loop could be hooked directly onto the extended frame of the skate between the brake pad and the rear wheel. Such attachment, however, should not impede the movement or rotation of the wheels.

The attachment means may comprise one or more hooks that are attached to, or are formed integrally with either the flexible upper, the flexible sole, or with the elastic band. Such hooks may be used to removably hook the invention directly onto receiving loops or openings located on the boot of the skate.

Alternatively, the attachment means may comprise one or more pockets, straps, clips, and/or side loops that are attached to or integrally formed with either the flexible upper, the flexible sole, or the elastic band. The pockets or straps may be used to removably engage the back of the tendon guard of the boot.

The side loops can be used to enable most any means of attachment to engage the apparatus and removably secure the apparatus to the boot of the skate during the second mode of use. The side loops also allow the apparatus to be secured to a belt of the skater or to a separate rope or strap when not secured to the skate.

In the third mode of use, the attachment means is inoperative, unless the rear loop is used as a heel strap for the protective foot covering.

The present invention achieves each of the above-stated objectives and overcomes the previously mentioned disadvantages and dangers.

These and other objectives and advantages of the present invention will become more readily apparent upon reading the following disclosure and referring to the attached drawings.

Figure 1:
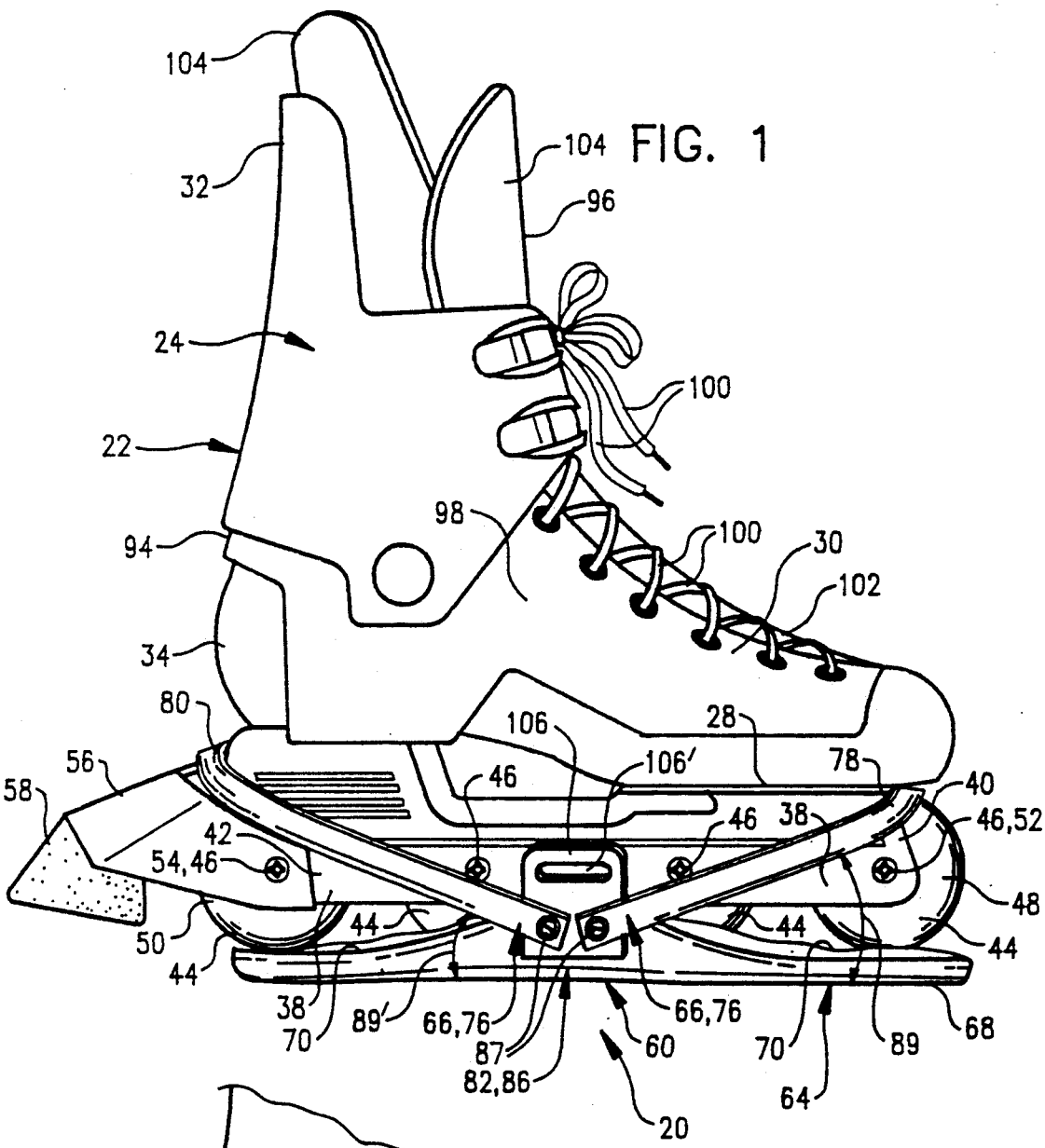
FIG. 1 is a side-elevational view of the present invention, showing the invention secured to a wheel housing of an in-line skate to form a skid resistant sole for the wheels of the skate.

One should understand that the drawings are not necessarily to scale and the elements are sometimes illustrated by graphic symbols, phantom lines, diagrammatic representations, and fragmentary views. In certain instances, the inventor may have omitted details which are not necessary for an understanding of the present invention or which render other details difficult to perceive.

BEST MODE FOR CARRYING OUT THE INVENTION

Referring to the drawings, wherein like numerals indicate like parts, apparatus 20 of the present invention is intended to be attached to an in-line roller skate 22. Apparatus 20 may also be attached to a conventional roller skate (not shown) or even to a conventional ice skate (not shown) if desired. To understand how apparatus 20 is attached to the skate 22, it is important to initially identify the pertinent portions of skate 22.

Since apparatus 20 is an attachment to or accessory for skate 22, skate 22 may comprise any conventional or nonconventional configuration and structure known in the sporting industry. Skate 22, however, should have at least a boot 24 within which a foot 26 of a skater may be inserted. Many boots for in-line roller skates are currently being molded as unitary or dual piece outer shells. A padded liner is then inserted into the outer shell, and the skater places his or her foot within the padded liner.

The boot 24 should have a boot sole 28 and a boot upper 30. The boot upper 30 is secured to the boot sole 28 by any appropriate means of manufacture. The boot upper 30 preferably has a tendon guard 32 or backstay and a heel 34. The tendon guard 32 could also be referred to as an upper portion of the boot 24 that is positioned near a calf (not shown) of the skater. The heel 34 could be referred to as a lower portion of the boot 24.

The skate 22 also has an elonqated frame 38 that is secured to the boot sole 28 and defines an undercarriage of the boot 24. The frame 38 has a front end 40 and an oppositely positioned rear end 42. A plurality of wheels 44 are rotatably mounted to the frame 38 to enable each wheel to rotate about an axis 46. More particularly, the wheels 44 must have at least a front wheel 48 and a rear wheel 50. The axis 52 of the front wheel 48 is substantially parallel to the axis 54 of the rear wheel 50. Many in-line skate wheels that are currently available are manufactured from durable urethane and have sealed ball bearings located near their axis of rotation.

The frame 38 may also be extended to accommodate attachment of a conventional brake pad housing 56 and brake pad 58.

The apparatus 20 can serve as a removable, shock-absorbent, flexible braking tread 60 or pad positioned between the wheels 44 and the underlying support surface (not shown) to prevent the rotation of the wheels 44 of the skate 22. The apparatus 20 may serve as a lightweight pack or storage compartment 62. In addition, the apparatus 20 may further serve as a separate protective foot covering 64 or shoe.

The apparatus 20 generally comprises the protective foot covering 64, and means 66 for removably attaching and/or urging the protective foot covering 64 to one or more locations on the skate 22.

The protective foot covering 64 may comprise any shoe, slipper, pump, sock, or other footwear that can be used as a common street shoe and still accomplish the tasks set forth herein. More specifically, the protective foot covering 64 must have a flexible sole 68 and a flexible upper 70 or vamp. The flexible sole 68 is attached to the flexible upper 70 by any appropriate manner known or used within the manufacture of footwear. The combination of the flexible sole 68 and the flexible upper 70 defines a cavity or enclosure 72 wherein the foot 26 of the skater can be placed. In an alternative mode of use, the enclosure 72 serves as a storage compartment to contain and hold various items (not shown) such as keys, extra clothing, etc. Use of the protective foot covering 64 as a storage compartment 62 will be discussed in greater detail below.

In the preferred embodiment, the protective foot covering 64 comprises a simple, inexpensive aqua-shoe, aqua-sock, or aqua-slipper. Aqua-shoes are becoming quite popular and are readily available from many distributors under many different brand names.

During the first mode of use, the wheels 44 will be in direct contact with the flexible upper 70. Consequently, the flexible upper 70 of the protective foot covering 64 should be made of a durable, yet elastic material. The fabric should provide a snug fit to the foot 26 of the skater when the apparatus 20 is used as a shoe. The fabric may also undergo some stress when the apparatus 20 is being used as the storage compartment 62, particularly, if the apparatus 20 must hold excessively large or heavy loads. Thus, there exists a need that the fabric of the flexible upper 70 have adequate, durable elasticity.

The flexible upper 70 of most aqua-shoes is made of an elastic fabric which expands and contracts to different sizes of feet. If various items are placed within the enclosure 72, the elastic fabric causes the aqua-shoe and its contents to remain relatively compact, and to be snugly and firmly held in place without significant shifting.

Many aqua-shoes also have an elastic heel strap 74 or rear cinch band that can be used to urge the foot 26 of the skater into the enclosure 72 and hold the aqua-shoe onto the foot of the skater when the aqua-shoe is detached from the skate 22.

The second element of the apparatus 20 comprises means 66 for removably attaching and/or urging the protective foot covering 64 to one or more locations on the skate 22. The attachment means 66 may take any appropriate form or structure which accomplishes the described task. For example, in the preferred embodiment of the invention, the attachment means 66 comprises at least one elastic band 76 or cord that is secured to the protective foot covering 64. The elastic band 76 is formed to have a large elastic front loop 78 and a large elastic rear loop 80.

Because the front loop 78 and rear loop 80 are relatively large in comparison to the size of the apparatus 20, each band has a greater pulling strength and the elastic forces are distributed over a larger length of band than bands having a shorter length.

The angles of attachment between the apparatus 20 and the skate 22 are also less than if the bands were shorter and had to be attached at the ends of the flexible sole 68. Thus, if the bands were short and were attached at the respective ends of the flexible sole 68, there would be a greater tendency that the bands would slip over and off of the front and rear wheels 48 and 50 during conditions of elastic stress as would occur during the first mode of use of the invention. In addition, the sole might suffer undesirable deformation in the toe and heel if the straps were short and were attached at the ends of the flexible sole 68. Consequently, the bands of the preferred embodiment are relatively large and are attached at generally the middle or midpoint of the sides of the flexible sole 68.

The front loop 78 and the rear loop 80 may be manufactured from a single piece of elastic material, such as from silicon or rubber. Alternatively, the front loop 78 and the rear loop 80 may be manufactured from separate strips of elastic material which are joined or are independently secured to the protective foot covering 64.

Figure 5:
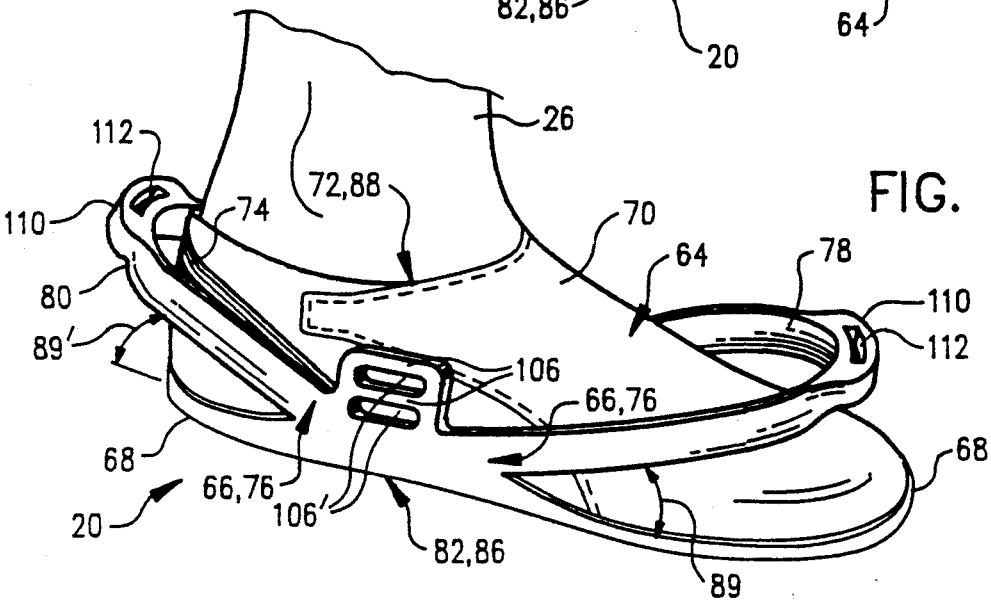
FIG. 5 is an isometric view of the invention illustrated in FIG. 1, showing the invention secured to a foot of a skater.
Figure 2:
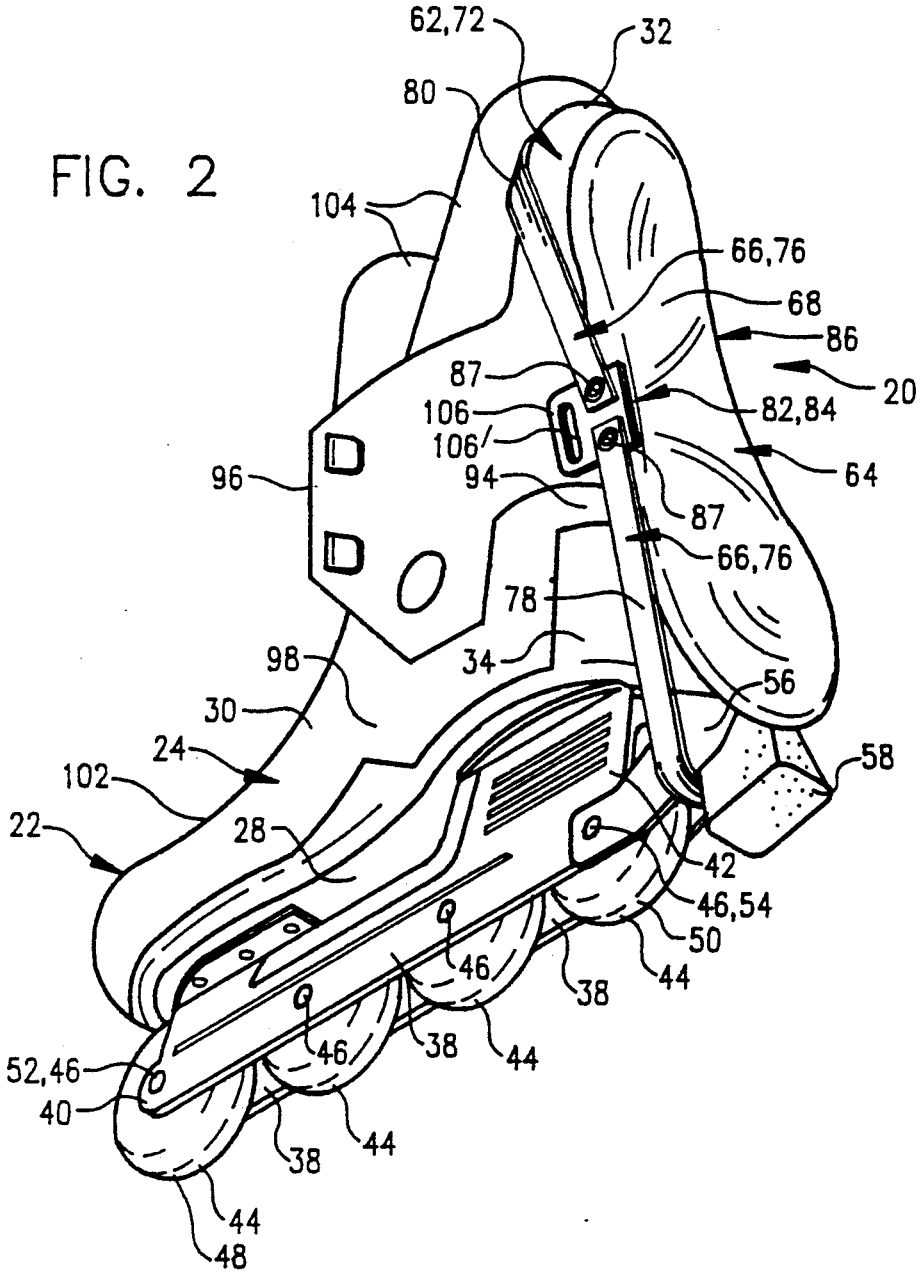
FIG. 2 is an isometric view of the invention illustrated in FIG. 1, showing the invention secured to a rear portion of a boot and wheel housing of the in-line skate to form at least a partially closed storage compartment.
Figure 3:
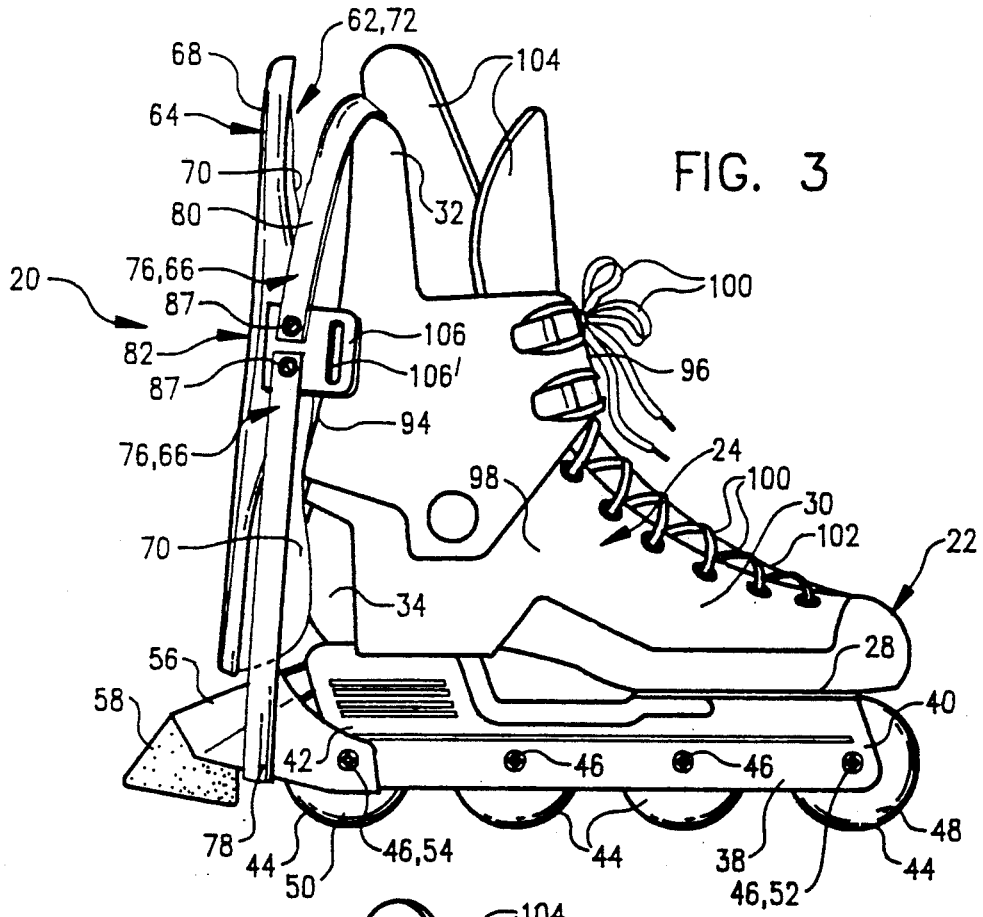
FIG. 3 is a side-elevational view of the invention illustrated in FIG. 2.
Figure 4:
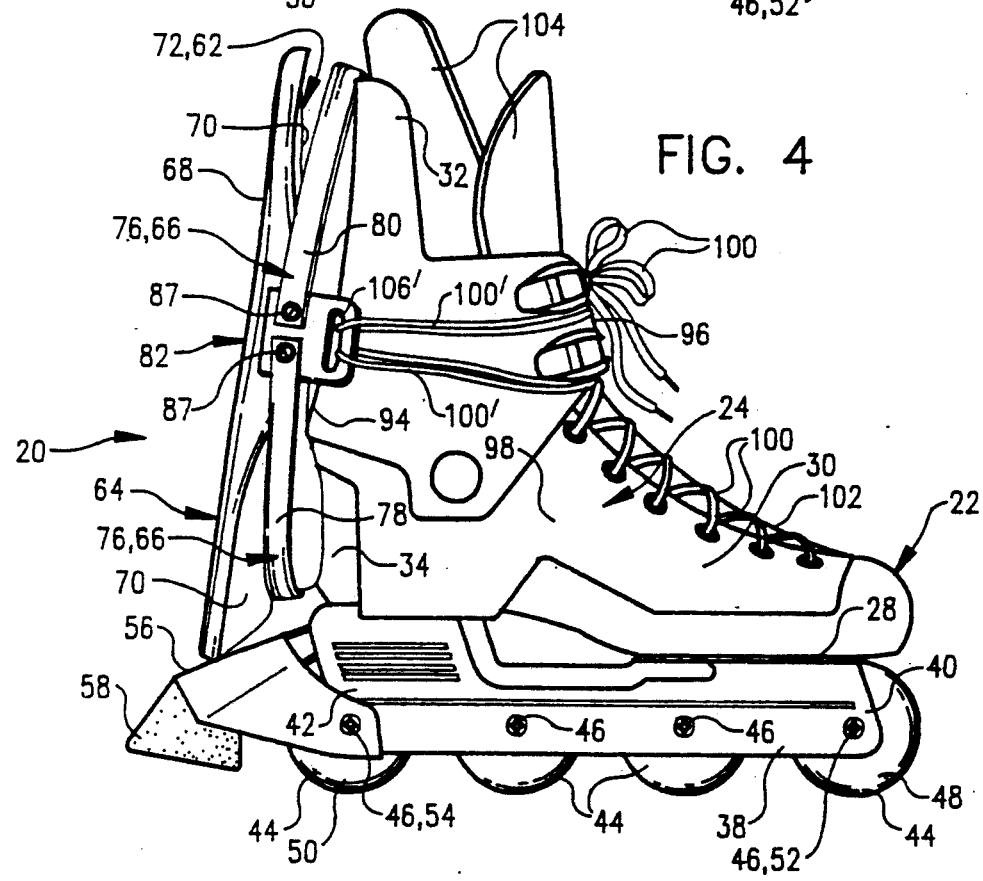
FIG. 4 is a side-elevational view of the invention illustrated in FIG. 3, except that a different means for attachment is used.

The front loop 78 and the rear loop 80 of the prototype of the apparatus 20 are manufactured from automotive bungee cords. However, as illustrated in FIG. 5, front and rear loops 78 and 80 could be formed from a single, unitary piece of rubber to ensure added strength and to remove undue stress from the protective foot covering 64.

The elasticity of elastic band 76 allows for its attachment to differently sized skate wheel bases. In the preferred embodiment, the rear loop 80 is sized so that the rearmost end of the rear loop 80 is located just slightly over the rear end or heel of the flexible sole 68.

The elastic band 76 or bands are preferably attached at or near the center of each side of a shank 82 of the protective foot covering 64. For example, the elastic band 76 can be secured to the flexible sole 68 near an instep or arch 84 and near an opposite outstep 86 of the protective foot covering 64.

The elastic band 76 may be attached to the protective foot covering 64 by any appropriate means of attachment. For example, the elastic band 76 may be formed as an integral part of the flexible sole 68 of the protective foot covering 64. Alternatively, the elastic band 76 may be sewn, bolted with bolts 87, clamped, adhered, or otherwise affixed to the flexible sole 68 or to the flexible upper 70 of the protective foot covering 64.

In the preferred embodiment, the front loop 78 and the rear loop 80 are positioned around the front and rear portions of the protective foot covering 64, respectively. The front loop 78 is positioned with an upward acute angle 89 with respect to the flexible sole 68. The rear loop 80 is positioned with an upward acute angle 89' with respect to the flexible sole 68. The slight upward angles 89 and 89' urge the front and rear loops 78 and 80, respectively, to be positioned at a raised incline with respect to the flexible sole 68 and wheels 44. Thus positioned, if during the first mode of use, for one reason or another the elasticity of the front and/or rear loops 78 and 80 are temporarily slackened, the front and rear loops 78 and 80 will maintain their original orientation with respect to the wheels 44 and frame 38. For example, if an excessive amount of stress is placed upon one of the loops, it is conceivable that the tension in the opposite loop could temporarily be slackened. Thus configured, when the tension forces and elasticity in the front and/or rear loops 78 and 80 return, the outer ends of front and rear loops 78 and 80 will stay up in an elevated position so that the front wheel 48 or rear wheel 50 are not able to roll over front loop 78 or rear loop 80, respectively. Consequently, front and rear loops 78 and 80 will reengage the wheels 44 and/or the frame 38 as explained above.

In the preferred embodiment, the angle of inclination causes the outer ends of the front and rear loops 78 and 80 to extend approximately three (3) inches above the flexible sole 68 at the toe and heel of the protective foot covering 64.

After the protective foot covering 64 or aqua-shoe is so manufactured and/or modified, the apparatus 20 may be used in the following manner. As briefly described above, the present invention may be used in three different modes.

In the first and second modes of use, the protective foot covering 64 is removed from the foot 26 of the skater or wearer and is attached to the skate 22 in either of two or more positions.

In the first mode of use, the apparatus 20 is removed from the foot 26 of the skater and/or from the boot 24 of the skate 22. The enclosure 72 of the protective foot covering 64 is emptied of its contents. The flexible upper 70 is juxtaposed against the lowermost surfaces of the wheels 44 of the skate 22.

The attachment means 66 is used to attach the protective foot covering 64 to the skate 22 in either its first and/or second mode or position.

The attachment means 66 may comprise one or more hook-and-loop fasteners, such as the fasteners sold under the trademark VELCRO. Similarly, the attachment means 66 may comprise one or more snaps, hooks, clasps, buckles, laces, ties, or other means which enables the protective foot covering 64 to be removably secured to the skate 22. The attachment means 66 must simply urge the flexible upper 70 against the wheels 44 to restrict rotational movement of the wheels 44 with respect to the frame 38.

In the preferred embodiment of the invention, the attachment means 66 comprises the elastic band 76 described above. The elastic band 76 may be stretched to hook onto the frame 38, wheels 44, or boot 24 of the skate 22, and thereby removably secure the protective foot covering 64 to the skate 22. Where front loop 78 and rear loop 80 are provided, front loop 78 may be pulled and stretched to hook onto the front wheel 48, onto the toe of boot 24, or onto the front end 40 of the frame 38. Similarly, rear loop 80 may be pulled and stretched to hook onto the rear wheel 50, onto the heel of the boot 24, or onto the rear end 42 of the frame 38. The elasticity of the elastic band 76 or front and rear loops 78 and 80 urges the protective foot covering 64 to maintain a close interrelationship with the frame 38 and the wheels 44 of the skate 22.

The attachment means 66 urges the flexible upper 70 of the protective foot covering 64 into direct physical contact with the otherwise rotatable wheels 44 of the skate 22. In other words, the attachment of the attachment means 66 to one or more portions of the skate 22 removably secures the protective foot covering 64 to the lowermost portions of the wheels 44 of the skate 22. When weight is placed upon the wheels 44, the direct contact and frictional resistance of the protective foot covering 64 against the wheels 44 immobilizes the wheels 44 and prevents the wheels 44 from rotating.

In essence, in the first mode of use, the apparatus 20 effectively brakes the wheels 44 of the skate 22, prevents rotation of the wheels 44, and converts the skate 22 into an elevated shoe or boot. Once so attached, the skater may easily walk within establishments and on stairs in complete safety as though the skater was simply walking on elevated or raised shoes.

It is important to note that the attachment of the front and rear loops 78 and 80 to the instep 84 and outstep 86 of the protective foot covering 64, and the attachment of the taut front and rear loops 78 and 80 to the apparatus 20 against the lowermost portions of the wheels 44 of an in-line skate, cause the flexible sole 68 and flexible upper 70 to bend around the sides of the wheels 44. This causes the protective foot covering 64 to have a U-shaped cross-section when so attached. The U-shaped cross-section or curvature of the flexible sole 68 gives added rigidity and structural strength to the flexible sole 68. Consequently, when the skater walks with the protective foot covering 64 secured to the wheels 44, the toe and heel of the protective foot covering 64 are prevented from flapping, or inadvertently catching on objects or folding back as the skater walks.

When in its second mode of operation, the wheels 44 of the skate 22 are allowed to rotate. In the second mode of use, the protective foot covering 64 is removed from both the skate 22 and from the foot 26 of the skater. The enclosure 72, which is formed between the insole of the flexible sole 68 and the flexible upper 70 of the protective foot covering 64, serves as the storage compartment 62, pocket, pack, or carrier which can hold and retain various items. Items such as keys, wallets, extra clothing, etc., may be inserted through the foot opening 88 in the protective foot covering 64 to completely or partially fill the interior enclosure 72.

If the flexible upper 70 is made of an elastic fabric or material, the upper 70 functions as an expandable bladder that can expand or contract as needed. The expansion and contraction of the elastic fabric enables the protective foot covering 64 to snugly grasp and carry a large volume of cargo, and yet maintain a minimal size during use. In other words, the protective foot covering 64 can be filled with carry-along items and be used as a separate and/or additional storage compartment 62 or pack.

Once the items have been placed within the enclosure 72 or cavity of the protective foot covering 64, the flexible upper 70 is juxtaposed against the outside of the boot 24. In the preferred embodiment, the flexible upper 70 is juxtaposed against the tendon guard 32 and the heel 34 or rear sole of the boot 24. The tendon guard 32 is also known as the calf portion, upper portion, or backstay of the boot 24.

Thus positioned, the foot opening 88 to the enclosure 72 is juxtaposed against and is urged toward the body of the boot 24. Such positioning and attachment automatically closes the foot opening 88 and prevents the escape of the items held within the enclosure 72.

In an alternative embodiment, the protective foot covering 64 is provided with an enlarged tongue 90 (not shown) or flap which can be placed over the foot opening 88 to the enclosure 72. The tongue 90 may be secured in place by any adequate means of attachment. For example, the tongue 90 can be held over the foot opening 88 by use of a string, a hook-and-loop fastener system, a zipper, one or more snaps, a button, or other such structures. The tongue 90 can be entirely removable from the apparatus or be permanently attached thereto. In essence, the tongue 90 turns the apparatus 20 into a closable purse that can be used to temporarily secure the stored items within the enclosure 72 and to prevent escape therefrom.

If the tongue 90 is permanently attached to the protective foot covering 64, the tongue 90 can either be tucked into the enclosure 72 of the apparatus 20, or be simply allowed to hang out loosely as are the tongues of various tennis shoes worn by young persons of today.

Instead of or in addition to using the tongue 90, the perimeter of the foot opening 88 could be provided with a drawstring (not shown) which when engaged can be used to reduce the size of the foot opening 88 and thereby secure the items within the enclosure 72.

The apparatus 20 of the present invention easily lends itself to a wide variety of other positions of attachment to the skate 22. For example, the apparatus 20 may be secured to the back 94, to the front 96, or to the side 98 of the boot 24. The apparatus 20 may even be secured to the buckles (not shown), laces 100, vamp 102, or the exposed inner liner 104 of the boot 24.

The placement of the apparatus 20 to the boot 24 is largely dependent upon the particular needs and desires of the skater. Some skaters will skate with their boots in very close proximity to each other and on both sides of each other. Consequently, such a skater would wish to secure the invention to either the back 94, to the front 96, or to the vamp 102 of the boot 24, and leave the sides 98 of the boot 24 unobstructed. If the attachment means 66 included the front loop 78 and the rear loop 80, as described above, the rear loop 80 could be hooked onto either a specially provided hook (not shown but readily apparent) which is independently secured to the boot 24, or rear loop 80 could be hooked directly onto the uppermost portions of the tendon-guard 32 of the boot 24. The front loop 78 is then hooked onto either a second hook that is specially provided (not shown but readily apparent), or is hooked directly onto the boot sole 28, onto the frame 38, onto the rear wheel 50, or onto the brake pad housing 56, as desired.

If the protective foot covering 64 is provided with an elastic heel strap 74, the elastic heel strap 74 can be hooked directly onto the uppermost portions of the tendon guard 32 of the boot 24, instead of hooking the rear loop 80 thereon as described immediately above.

Alternatively or in addition to the above-desired features, the apparatus 20 may be provided with at least one projection or side loop 106 which is attached to the flexible sole 68, to the flexible upper 70, or to the attachment means 66, or is integrally formed therewith.

In the preferred embodiment, the side loop 106 is approximately two (2) inches wide and one-and-one-half (1.5) inches long. Each side loop 106 could have one or more slots 106' or apertures of any desired dimension. Preferably, slots 106' are approximately one-and-one-half (1.5) inches wide.

If needed, a separate cord 100', ties, straps, or hooked bungee cords could engage the side loop 106 by means of passing through the slot 106'. For example, use of the side loop 106 enables the apparatus 20 to be removably secured to the boot 24 by passing the laces 100 and/or a separate cord 100' through a first slot 106' in a first side loop 106, around the boot 24, and then secure the laces 100 and/or cord 100' to a similar second slot 106' in a second side loop 106 located on the opposite side of the apparatus 20. The laces 100 and/or the separate cord 100' may then be hooked, tied, or otherwise secured to secure the apparatus 20 to the boot 24.

Cord 100' may comprise any form of elastic or nonelastic cordage. For example, cord 100' may comprise a bungee cord having one or more hooks at its terminal ends that can hook a slot 106' in side loop 106, wrap around the skate and/or the frame 38, and then hook into another slot 106' of a different side loop 106 located on an opposite side of apparatus 20.

The slotted side loop 106 may further be used as a belt loop through which a belt (not shown) or strap may pass, thereby enabling the apparatus 20 to be worn as a fanny pack about the waist of the skater.

The side loop 106 may also comprise a plurality of side slots 106' which accommodate easy selective adjustment of the attachment of the apparatus 20 to the boot 24 and/or to the belt of the skater.

Alternatively, the skate 22 may be provided with outwardly projecting prongs (not shown) onto which one or more side loop 106 may be secured by the passage of the prongs through slots 106'.

In the third mode of use or operation, the skate 22 is removed from the foot 26 of the skater and is replaced with the protective foot covering 64. Thus, the skater wears the protective foot covering 64 as a common street shoe. The protective foot covering 64 is primarily held in place upon the foot 26 of the wearer by the contraction of the elastic fabric of the flexible upper 70.

As mentioned above, many aqua-shoes have an elastic heel strap 74 or rear cinch band sewn to the fabric which passes over the heel but under the ankle of the wearer to securely hold the shoe or slipper onto the foot 26. If the apparatus 20 is provided with an elastic heel strap 74 or cinch band, the heel strap 74 is pulled over the skater's heel and the protective foot covering 64 is worn as a standard street shoe.

If the apparatus 20 is not provided with an elastic heel strap 74, the rear loop 80 may be utilized as an ankle strap, as commonly found on traditional thongs.

When the protective foot covering 64 is worn by the skater, the front loop 78 and the rear loop 80 are positioned, respectively, around the front and rear portions of the foot. In this third mode of use, the front and rear loops 78 and 80 serve no immediate purpose. The front and rear loops 78 and 80 are positioned at an upward acute angle with respect to the flexible sole 68. The slight upward angle urges the front and rear loops 78 and 80 to be suspended slightly above the flexible upper 70 or vamp of the protective foot covering 64. Thus positioned, during the third mode of use, the front and rear loops 78 and 80 do not necessarily make contact or rub against the flexible upper 70 of the protective foot covering 64.

As illustrated on FIG. 5, to accommodate easy gripping and manipulation, the attachment means 66 may further comprise one or more pull tab 110 which is secured to the elastic band 76. For example, front loop 78 and rear loop 80 may each be provided with one or more pull tab 110. If desired, pull tab 110 may have an indent or a slot 112 therein to facilitate easy gripping and manipulation. Slots 112 may also be used as an additional means whereby the apparatus 20 can be attached to the boot 24 or to the frame 38 of the skate.

The flexible sole 68, flexible upper 70, and attachment means 66 may all serve as surfaces upon which trademark and/or advertising indicia may be molded, adhered, or printed.

The means and construction disclosed herein are by way of example and comprise primarily the preferred form of putting the invention into effect. Although the drawings depict a preferred embodiment of the invention, other embodiments have been described within the preceding text. One skilled in the art will appreciate that the disclosed device may have a wide variety of shapes and configurations. Additionally, persons skilled in the art to which the invention pertains might consider the foregoing teachings in making various modifications, other embodiments, and alternative forms of the invention.

It is, therefore, to be understood that the invention is not limited to the particular embodiment or specific features shown herein. To the contrary, the inventor claims the invention in all of its forms, including all modifications, equivalents, and alternative embodiments which fall within the legitimate and valid scope of the appended claims, appropriately interpreted under the Doctrine of Equivalents.

INDUSTRIAL APPLICABILITY

The present invention is an accessory for in-line skates which permits a single apparatus to function as: (a) a brake to secure the wheels of the skate against rotation; (b) a protective pad between the wheels of the skate and an underlying walking surface; (c) a separate detachable protective foot covering or street shoe; and (d) a separate storage compartment which is removably attached to the boot of the skate. The apparatus of this invention is very efficient, reliable, compact, rugged, and durable in design. The invention is easily constructed and assembled. The invention is inexpensive and economical to manufacture. The invention is also extremely simple to use, and is compact and unobtrusive during operation.

I claim:

1. An apparatus for selectively securing a plurality of wheels of a skate against rotation upon an underlying support surface, the skate having a boot within which a foot of a skater may be inserted, the boot having a boot sole and a boot upper secured to the boot sole, the boot upper having a tendon guard or backstay and a heel, the skate having an elongated frame carried by the boot, the frame having a front end and a rear end, the wheels having at least a front wheel and a rear wheel, the front wheel and the rear wheel being rotatably mounted to the frame to enable each wheel to rotate about an axis, the axis of the front wheel being substantially parallel to the axis of the rear wheel, said apparatus comprising:

(a) a protective foot covering having a flexible sole and a flexible upper attached to said flexible sole, said flexible sole and said flexible upper defining an enclosure wherein the foot of the skater can be placed; and (b) means for removably attaching said protective foot covering to the skate such that said flexible upper can be juxtaposed and urged against the wheels to restrict rotational movement of the wheels with respect to the frame, said flexible sole defining a flexible pad positioned between the wheels and the underlying support surface when said apparatus is juxtaposed against the wheels of the skate, said protective foot covering defining a separate shoe or slipper when removed from the skate.

2. The apparatus of claim 1, wherein said apparatus further comprises a flexible pad positioned between the wheels and the underlying surface, said flexible pad being removably secured to the skate by said attachment means.

3. The apparatus of claim 1, wherein said upper of said protective foot covering comprises an elastic fabric.

4. The apparatus of claim 1, wherein said upper of said protective foot covering further comprises an elastic heel strap or rear cinch band that urges the foot of the skater into said enclosure and holds the protective foot covering upon the foot of the skater when said apparatus is detached from said skate.

5. The apparatus of claim 3, wherein said protective foot covering is an aqua-shoe or slipper.

6. The apparatus of claim 1, wherein said attachment means comprises at least one band which is removably secured to said skate, said band urging said flexible upper of said protective foot covering against the wheels to restrict rotation of the wheels with respect to the frame.

7. The apparatus of claim 6, wherein said band has a front loop and a rear loop, said front loop hooking onto the front end of the frame, said rear loop hooking onto the rear end of the frame.

8. The apparatus of claim 7, wherein said band is secured to said flexible sole near an instep or arch and near an opposite outstep of said protective foot covering.

9. The apparatus of claim 8, wherein said band is sewn, bolted, adhered, or clamped to said flexible sole of said protective foot covering.

10. The apparatus of claim 8, wherein said band is formed integrally with said flexible sole of said protective foot covering.

11. The apparatus of claim 7, wherein said apparatus further comprises at least one pull tab secured to said band.

12. The apparatus of claim 1, wherein said enclosure of said protective foot covering defines a storage compartment within which items may be stored when said apparatus is removed from being juxtaposed against the wheels of the skate.

13. The apparatus of claim 12, wherein said attachment means also serves to attach and urge said protective foot covering against the boot of the skate and permit the wheels to rotate.

14. The apparatus of claim 13, wherein said attachment means comprises at least one band which is removably secured to said skate, said band urging said flexible upper of said protective foot covering against the boot of the skate to restrict escape of said items from within said storage compartment.

15. The apparatus of claim 14, wherein said band has a front loop and a rear loop, said front loop hooking onto the frame of the skate, said rear loop hooking onto the tendon guard or backstay of the boot.

16. The apparatus of claim 15, wherein the frame is extended to accommodate attachment of a brake pad, said front loop hooking onto the frame of the skate between the brake pad and the rear wheel.

17. The apparatus of claim 13, wherein said attachment means comprises at least one side loop attached to said flexible upper, or to said flexible sole, said side loop enabling said apparatus to be removably secured to the skate and allow rotation of the wheels.

* * * * *